US005722252A

United States Patent [19]

Kang et al.

[11] Patent Number: 5,722,252

[45] Date of Patent: Mar. 3, 1998

[54] COOLING AIR DISTRIBUTION APPARATUS FOR REFRIGERATOR

[75] Inventors: Ho Sul Kang; Kyung Kil Heo, both of Changwon, Rep. of Korea

[73] Assignee: LG Electronics, Inc., Seoul, Rep. of Korea

[21] Appl. No.: 728,324

[22] Filed: Oct. 10, 1996

[30] Foreign Application Priority Data

Oct. 13, 1995 [KR] Rep. of Korea ..... 28784/1995
Oct. 14, 1995 [KR] Rep. of Korea ..... 28882/1995

[51] Int. Cl.[6] ..... F25D 19/00; F25D 17/04

[52] U.S. Cl. ..... 62/455; 62/418; 62/408; 62/417

[58] Field of Search ..... 62/404, 407, 408, 62/417, 418, 440, 441, 454, 455, 298

[56] References Cited

U.S. PATENT DOCUMENTS

| | | | |
|---|---|---|---|
| 1,922,456 | 8/1933 | Powell | 62/408 |
| 2,962,875 | 12/1960 | Barroero | 62/418 |
| 3,027,732 | 4/1962 | Mann et al. | 62/408 |
| 4,662,186 | 5/1987 | Park | 62/265 |
| 4,671,074 | 6/1987 | Gostelow et al. | 62/186 |
| 5,584,191 | 12/1996 | Kwon | 62/417 |

*Primary Examiner*—William Doerrler
*Attorney, Agent, or Firm*—Ostrolenk, Faber, Gerb & Soffen, LLP

[57] ABSTRACT

An improved cooling air distribution apparatus for a refrigerator which is capable of easily installing a rack at a predetermined position in a refrigerator compartment by changing the structure of a rack and a cooling air distribution duct as well as distributing a cooling air in multiple directions, for thus enhancing a cooling air circulation efficiency in the refrigerator, which includes a plurality of receiving groove formed in a front surface of the cooling air distribution duct and each side wall surface in the refrigerator compartment, a plurality of cooling air inlet formed in the engaging groove for introducing the cooling air into the refrigerator compartment, and an opening/closing unit hinged to a reverse side of each cooling air inlet for opening/closing the cooling air inlet, and a rack duct insertable into each engaging groove and each cooling air inlet for discharging the cooling air into the refrigerator compartment in multiple directions.

7 Claims, 13 Drawing Sheets

COOLING AIR DISTRIBUTION APPARATUS FOR REFRIGERATOR

BACKGROUND OF THE INVENTION

1. Field of the Invention

The present invention relates to a cooling air distribution apparatus for a refrigerator, and particularly to an improved cooling air distribution apparatus for a refrigerator which makes it possible to more easily and quickly install a rack at a predetermined position in a refrigerator compartment by changing the structure of the rack and a cooling air distribution duct as well as distributing cooling air in multiple directions, for thus enhancing cooling air circulation efficiency in the refrigerator.

2. Description of the Conventional Art

FIG. 1 is a perspective view illustrating a conventional cooling air distribution apparatus for a refrigerator, and FIG. 2 is a cross-sectional view of the conventional cooling air distribution apparatus as shown in FIG. 2.

As shown therein, a refrigerator compartment 1 includes a slot-shaped receiving groove 4 formed in an inner wall 2 of the refrigerator compartment 1 and a cooling air distribution duct 3. A spaced-apart pair of cooling air outlets 6 are formed spaced-apart in the receiving groove 4 of the cooling air distribution duct 3 for introducing cooling air generated by an evaporator 5 into the refrigerator compartment 1.

A rack duct 7 includes a rectangular upper plate 8 and a rectangular lower plate 9 mating with the upper plate 8 when the upper and lower plates 8 and 9 are assembled together.

The upper plate 8 includes a front wall 10 and a rear wall 11 which are downwardly extended from a top thereof. A plurality of engaging protrusions 13 are formed in the lower surface of the upper plate 8. A spaced-apart pair of upper conduit members 14 are extended form the rear wall 11.

The lower plate 9 mates with the upper plate 8. A second front edge 15 of the lower plate 9 mates with the front wall 10 of the upper plate 8, and side walls 16 extend from the lower plate 9 for being coupled with the top 12 of the upper plate 8.

A rear wall 17 is extended to the same height as the side walls 16 for being coupled with the inner side of the rear wall 11 of the top plate 8. A spaced-apart pair of lower conduit members 14 mate with the first guide path members 14 to/from conduits which can be inserted into the cooling air inlets 6, respectively.

A plurality of fastening holes 19 are formed in the lower plate 9 for fastening the engaging protrusions 13 of the upper plate 8. A plurality of cooling air discharging holes 20 are formed in the lower plate 9 in order for the cooling air introduced into the assembled rack duct 7 through the conduit members 14 and 18 to be discharged into the refrigerator compartment 1.

The operation of the conventional cooling air distribution apparatus for a refrigerator will now be explained with reference to FIGS. 1 and 2.

First, the upper plate 8 and the lower plate 9 are coupled together so as to assemble the rack duct 7. Thereafter, when the rack unit is inserted into the receiving groove 4, the cooling air conduit; which are formed by the coupling of the upper and lower conduit members 14 and 18, are inserted into the cooling air inlets 6.

In the above-described state, when the refrigerator is operated, the cooling air generated by the evaporator 5 is introduced through the cooling air distribution duct 3 into the rack duct 7 through the conduit members 14 and 18 inserted into the cooling air inlets 6.

The thusly introduced cooling air flows into the refrigerator compartment 1 through the cooling air discharging holes 20 of the rack duct 7.

However, when a bulky food is put in the refrigerator compartment 1, it may necessitate changing an installation position of the rack duct 7 or even taking out a corresponding rack duct 7 which interferes with the bulky food, for providing a space for such bulky food. In this case, when taking out the rack duct 7, the cooling air is still discharged from the cooling air inlets 6 from which the rack duct 7 was removed, so it is impossible to effectively control the amount of the cooling air.

In addition, since the cooling air is discharged only downwardly, the cooed air circulation efficiency is degraded.

In addition, since only the sides and rear portion of the rack duct 7 are supported by the receiving groove 4, when a heavy food is placed on the rack duct 7, the rack duct 7 may become flexed.

FIG. 3 is a cross-sectional view illustrating another conventional cooling air distribution apparatus for a refrigerator. As shown therein, a freezer compartment 21 and a refrigerator compartment 1 are separated by a barrier 22. A shroud 23 and a grill panel 24 are arranged in a rear portion of the freezer compartment 21. An evaporator chamber 25 is formed behind the shroud 23. A fan 26 and an evaporator 5 are installed in the evaporator chamber 25.

A first air returning path 27 is formed within the barrier 22 for air circulated in the freezer compartment 21 to be returned to the evaporator chamber 25. A second air return path 28 is formed below the first air return path 27 within the barrier 22, for an air circulated in the refrigerator compartment 1 to be returned to the evaporator chamber 25.

A cooling air distribution duct 3 is vertically installed at the rear portion of the refrigerator compartment 1 for guiding the cooling air introduced through a damper (not shown) thereinto.

A plurality of cooling air outlets 20 are formed spaced-apart along the cooling air distribution duct 3 in order for the cooled air generated by the evaporator 5 and introduced into the cooling air distribution duct 3 to be blown into the refrigerator compartment 1.

A plurality of racks 30 on which food may be placed are arranged spaced-apart in the refrigerator compartment 1.

The operation of this conventional cooling air distribution apparatus for a refrigerator will now be explained.

First, a part of the cooling air generated by the evaporator 5 is blown into the freezer compartment 21 through the shroud 23 and the grill panel 24 in cooperation with a blowing force generated by the fan 26. The air circulated in the freezer compartment 21 is returned to the evaporator chamber 25 through the first air return path 27 of the barrier 22.

Another part of the cooling air generated by the evaporator 5 is blown into the refrigerator compartment 1 through the cooling air outlets 20 formed in the cooling air distribution duct 3, and the air circulated in the refrigerator compartment 1 is returned to the evaporator chamber 25 through the second air return path 28.

However, since the cooling air is discharged through the cooling air outlets 20 formed in the cooling air distribution duct 3, it is impossible to effectively refrigerate a food placed in the front portion of the refrigerator compartment 1, and food placed directly in front of the cooling air outlets 20 may be overcooled.

In addition, when a bulky food is placed on the rack 30, it is impossible to effectively circulate the cooling air in the refrigerator compartment 1 due to an interference with the bulky food, so that the fan 26 may be applied with an overload.

SUMMARY OF THE INVENTION

Accordingly, it is an object of the present invention to provide a cooling air distribution apparatus for a refrigerator which overcomes the problems encountered in the conventional art.

It is another object of the present invention to provide an improved cooling air distribution apparatus for a refrigerator which is capable of more easily and quickly installing a rack at a predetermined position in a refrigerator compartment by changing the structure of a rack and a cooling air distribution duct as well as distributing cooling air in multiple directions, for thus enhancing a cooling air circulation efficiency in the refrigerator.

To achieve the above objects, in accordance with a first embodiment of the present invention, there is provided a cooling air distribution apparatus for a refrigerator which includes a plurality of receiving groove formed in a front surface of the cooling air distribution duct and each side wall surface in the refrigerator compartment, a plurality of cooling air inlet formed in the engaging groove for introducing the cooling air into the refrigerator compartment, and an opening/closing unit hinged to a reverse side of each cooling air inlet for opening/closing the cooling air inlet, and a rack duct insertable into each engaging groove and each cooling air inlet for discharging the cooling air into the refrigerator compartment in multiple directions.

To achieve the above objects, in accordance with a second embodiment of the present invention, there is provided a cooling air distribution apparatus for a refrigerator which includes a cooling air distribution duct having a plurality of cooling air inlets formed therein for introducing the cooling air generated by an evaporator into a refrigerator compartment and spaced-apart from one another, and a plurality of air outlets formed therein for sucking air circulated in the refrigerator compartment and spaced-apart from one another, an opening/closing unit disposed at a reverse side of each cooling air inlet for opening/closing the cooling air inlets, and a rack duct of which its front end is inserted into the cooling air inlet of the cooling air distribution duct for discharging the cooling air from the cooling air distribution duct into the refrigerator compartment in multiple directions.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
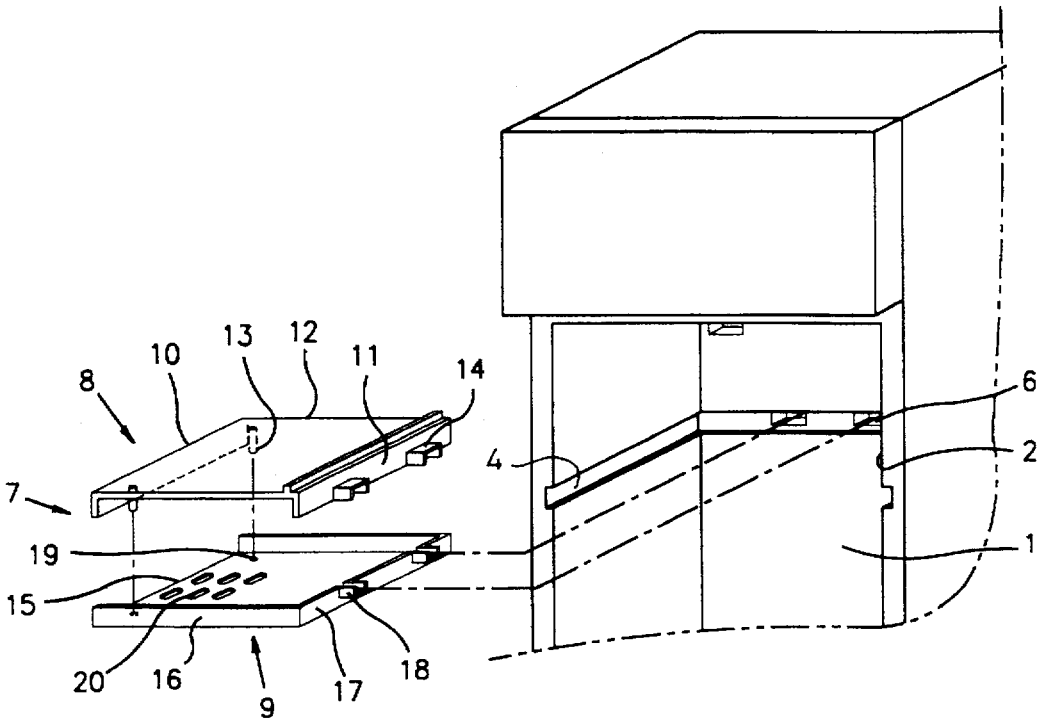
FIG. 1 CONVENTIONAL ART
FIG. 1 is a perspective view illustrating a conventional cooling air distribution apparatus for a refrigerator.
Figure 2:
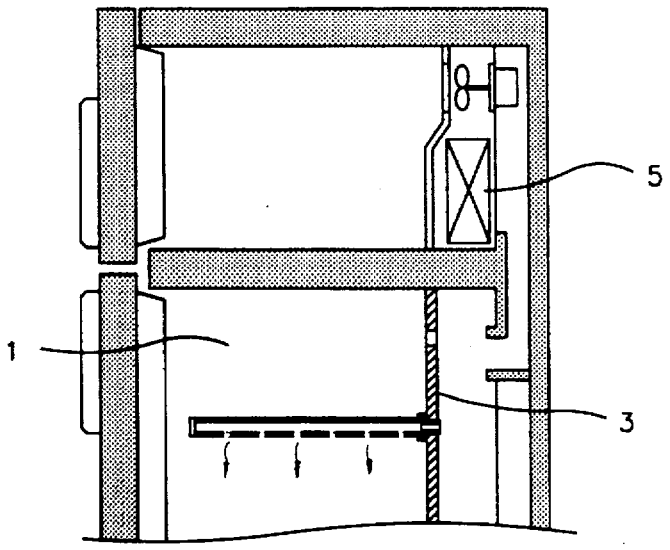
FIG. 2 CONVENTIONAL ART
FIG. 2 is a cross-sectional view of the conventional air distribution apparatus as shown in FIG. 2.
Figure 3:
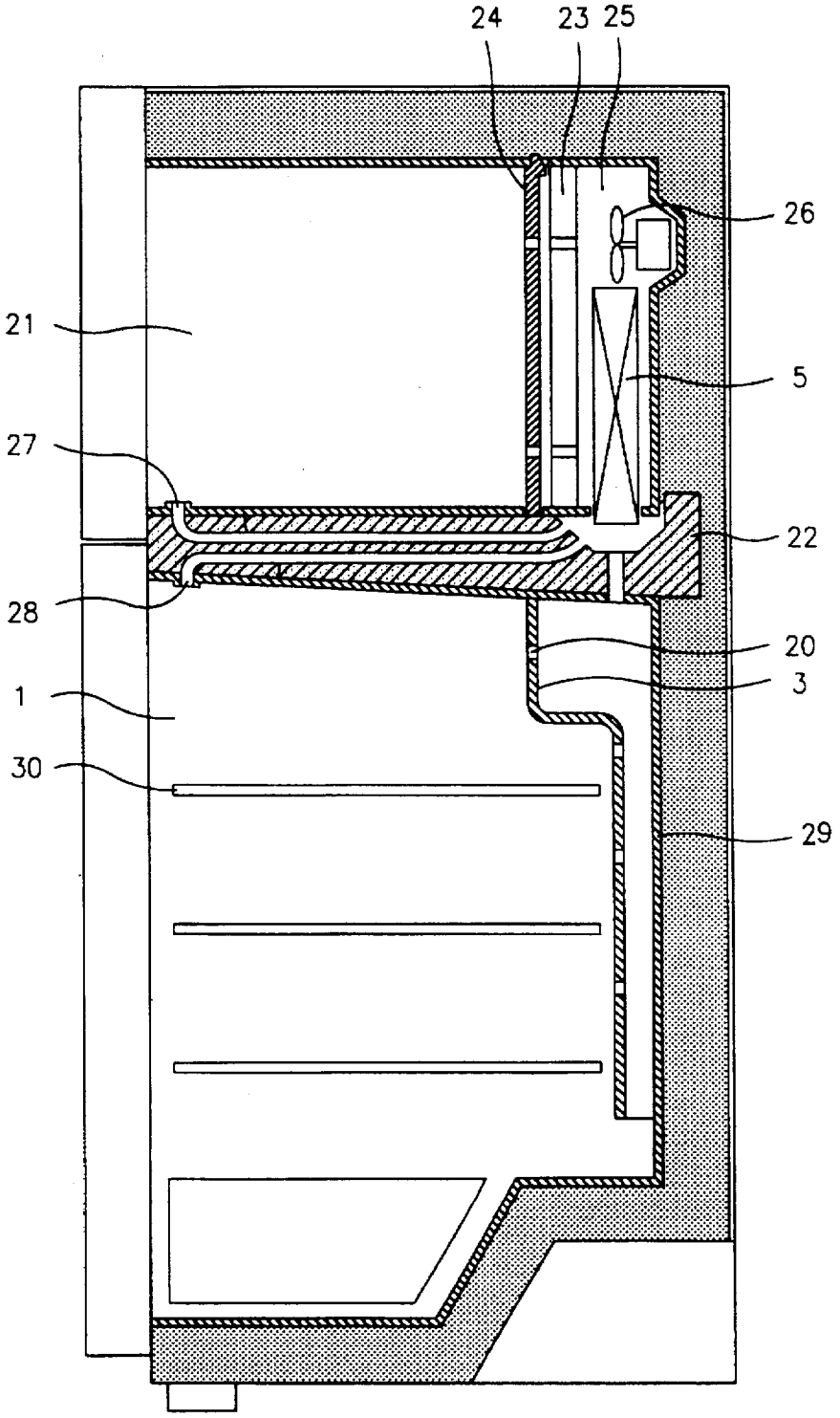
FIG. 3 CONVENTIONAL ART
FIG. 3 is a cross-sectional view illustrating another conventional cooling air distribution apparatus for a refrigerator.
Figure 4:
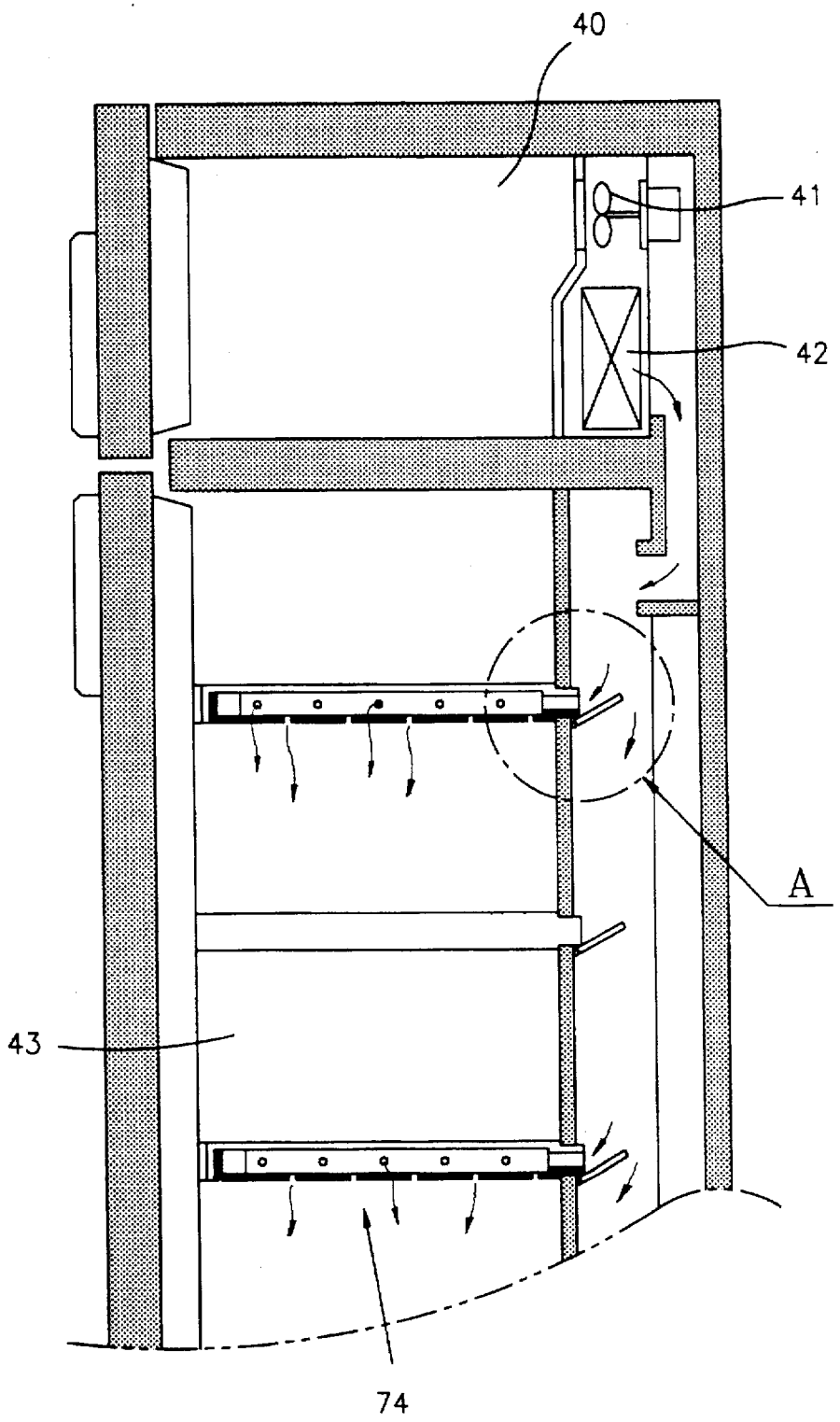
FIG. 4 is a cross-sectional view illustrating a cooling air distribution apparatus for a refrigerator according to a first embodiment of the present invention.
Figure 5:
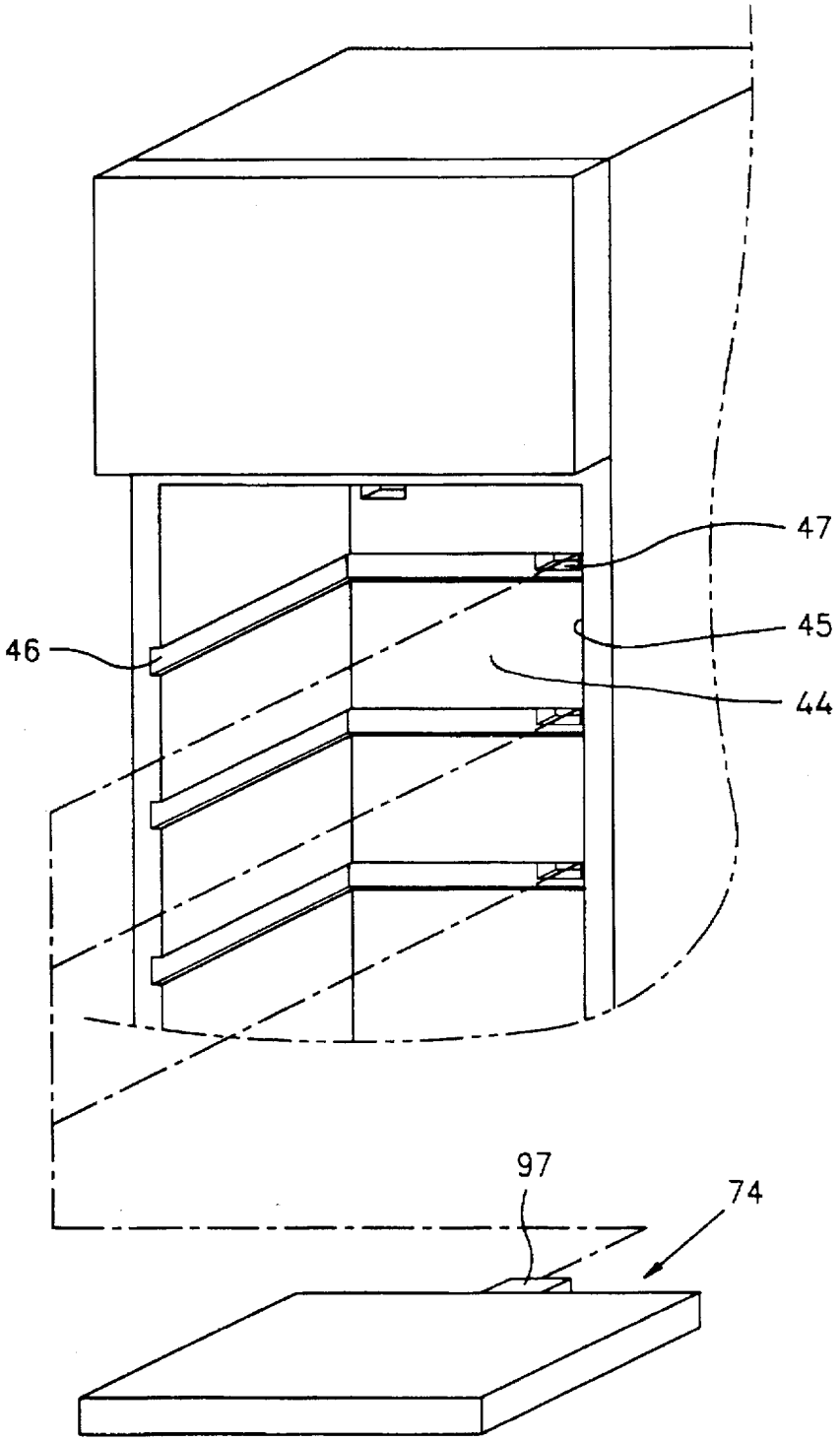
FIG. 5 is a perspective view illustrating the cooling air distribution apparatus as shown in FIG. 4.
Figure 6:
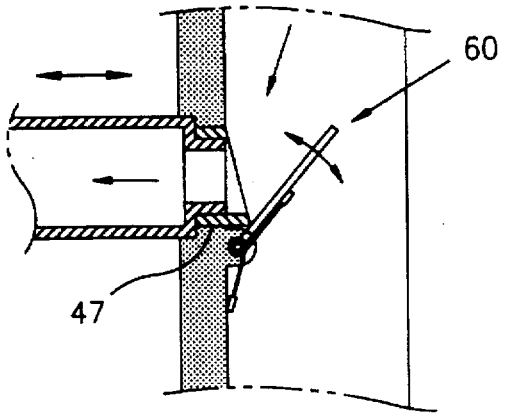
FIG. 6 is an enlarged view of a section "A" of FIG. 4.
Figure 7:
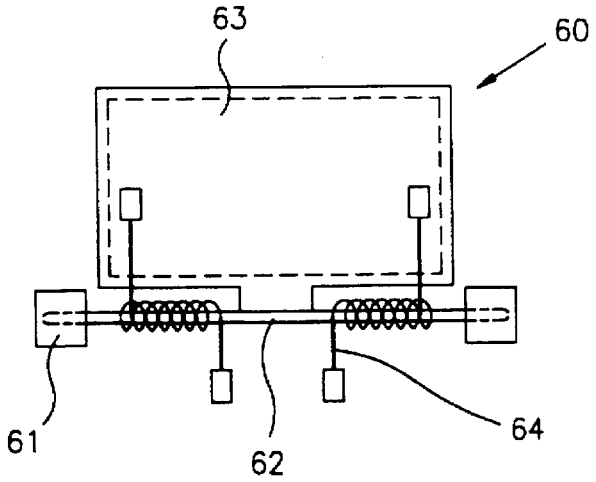
FIG. 7 is a detailed view of an opening/closing member of FIG. 4.

Referring to FIGS. 4 through 13, the cooling air distribution apparatus for a refrigerator according to a first embodiment of the present invention will now be explained.

As shown therein, in a rear portion of a freezer compartment 40 a fan 41 and an evaporator 42 are disposed. In a rear portion of a refrigerator compartment 43, a cooling air distribution duct 44 is vertically installed for guiding a cooling air generated by the evaporator 42 into the refrigerator compartment 43.

A plurality of slot-shaped receiving grooves 46 are formed at vertically spaced intervals in a front surface of the cooling air distribution duct 44 and the inner side walls 45 of the refrigerator compartment 43. A cooling air inlet 47 is formed in each receiving groove 46 in the front surface of the cooling air distribution duct 44 for blowing the cooling air introduced into the cooling air distribution duct 44 into the refrigerator compartment 43.

An opening/closing member 60 is disposed within each cooling air inlet 47 inside the cooling air distribution duct 44 for selectively opening/closing the cooling air inlets 47.

A pair of spaced-apart hinge supports 61 are formed at each side of each cooling air inlet 47, and the ends of a hinge pin 62 are rotatably inserted into the hinge supports 61.

An opening/closing plate 63 is fastened along its lower edge to a center portion of the hinge pin 62 for opening/closing the cooling air inlet 47. An elastic member 64 such as a torsion spring is engaged between one or both ends of opening/closing plate 63 and the rear surface of the cooling air distribution duct 44 for urging the opening/closing plate 63 into a closing position.

Figure 8:
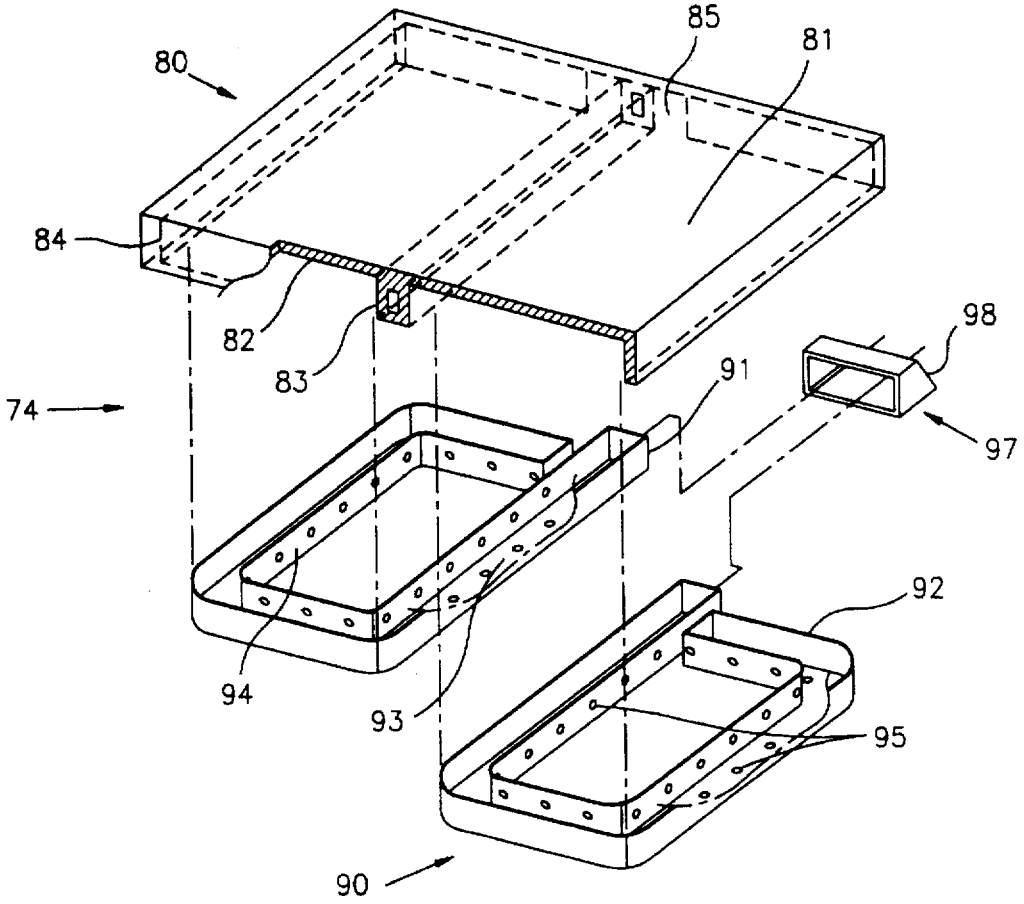
FIG. 8 is an exploded perspective view illustrating a rack duct of the cooling air distribution apparatus for a refrigerator as shown in FIG. 4.
Figure 9:
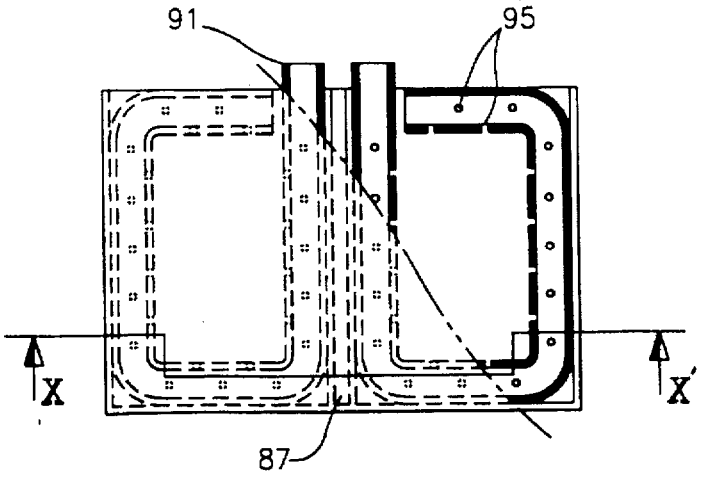
FIG. 9 is a partially cur away plan view illustrating the rack duct of the cooling air distribution apparatus for a refrigerator as shown in FIG. 4.
Figure 10:
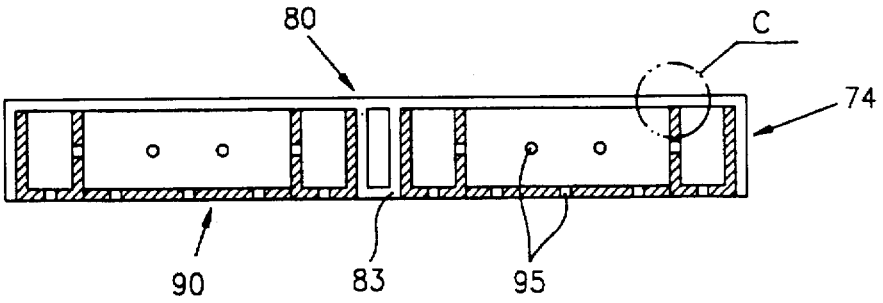
FIG. 10 is a cross-sectional view taken along line X–X' of FIG. 9.

As shown in FIG. 8, a rack duct 74 received in the receiving groove 46 includes an upper plate 80, a pair of channel-shaped cooling air guide members 90, and a cooling air conduit 97.

The upper plate 80 includes a rectangular upper surface 81, a lower surface 82, and a support bar 83 extending along the lower surface 82 for supporting the center portion of the upper plate 80.

A downwardly extended edge portion is formed along the edge of the upper plate 80, and notches are formed in the edge portion at each side of one end of the support bar 83.

A plurality of fixing grooves 86 are formed in the lower surface 82 of the upper plate.

The cooling air guide members 90 each includes an inlet 91 extended from one end thereof, through which the cooling air is introduced thereinto, and a rectangular guide channel 92 for guiding the cooling air introduced through the inlet 91 in order for the cooling air to flow therealong.

Figure 11:
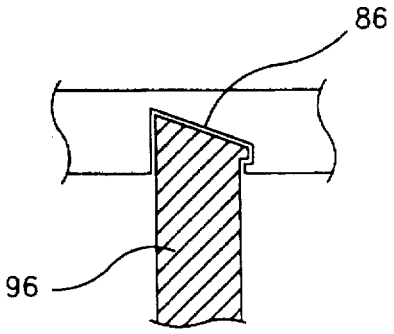
FIG. 11 is an enlarged cross-sectional view illustrating a section "C" of FIG. 10.
Figure 12:
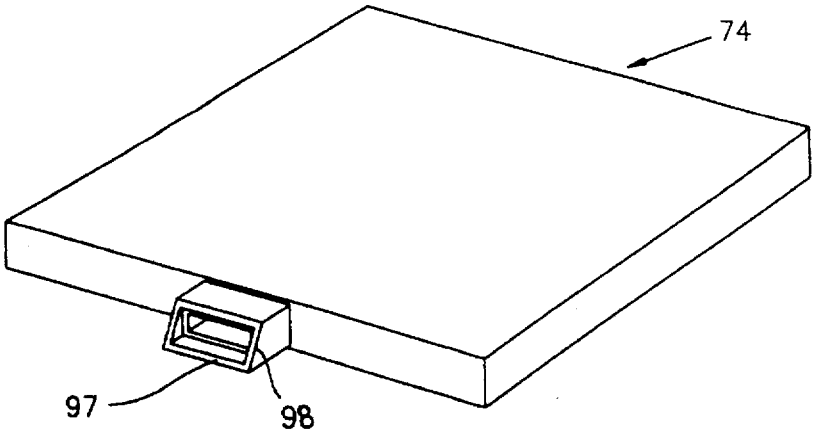
FIG. 12 is a perspective view illustrating the rack duct of the cooling air distribution apparatus for a refrigerator as shown in FIG. 4.
Figure 13:
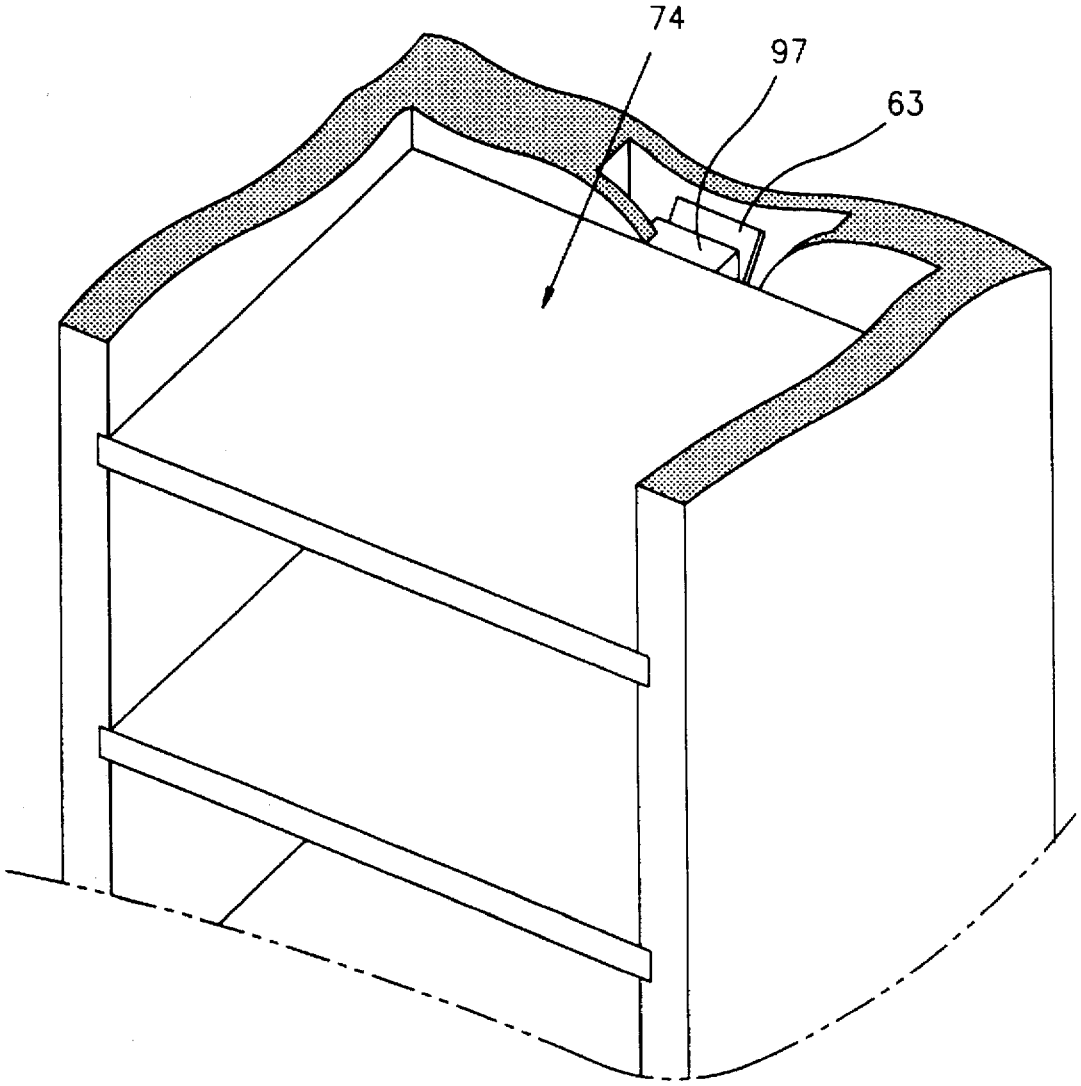
FIG. 13 is a partially cut away perspective view illustrating the cooling air distribution apparatus for a refrigerator as shown in FIG. 4.
Figure 14:
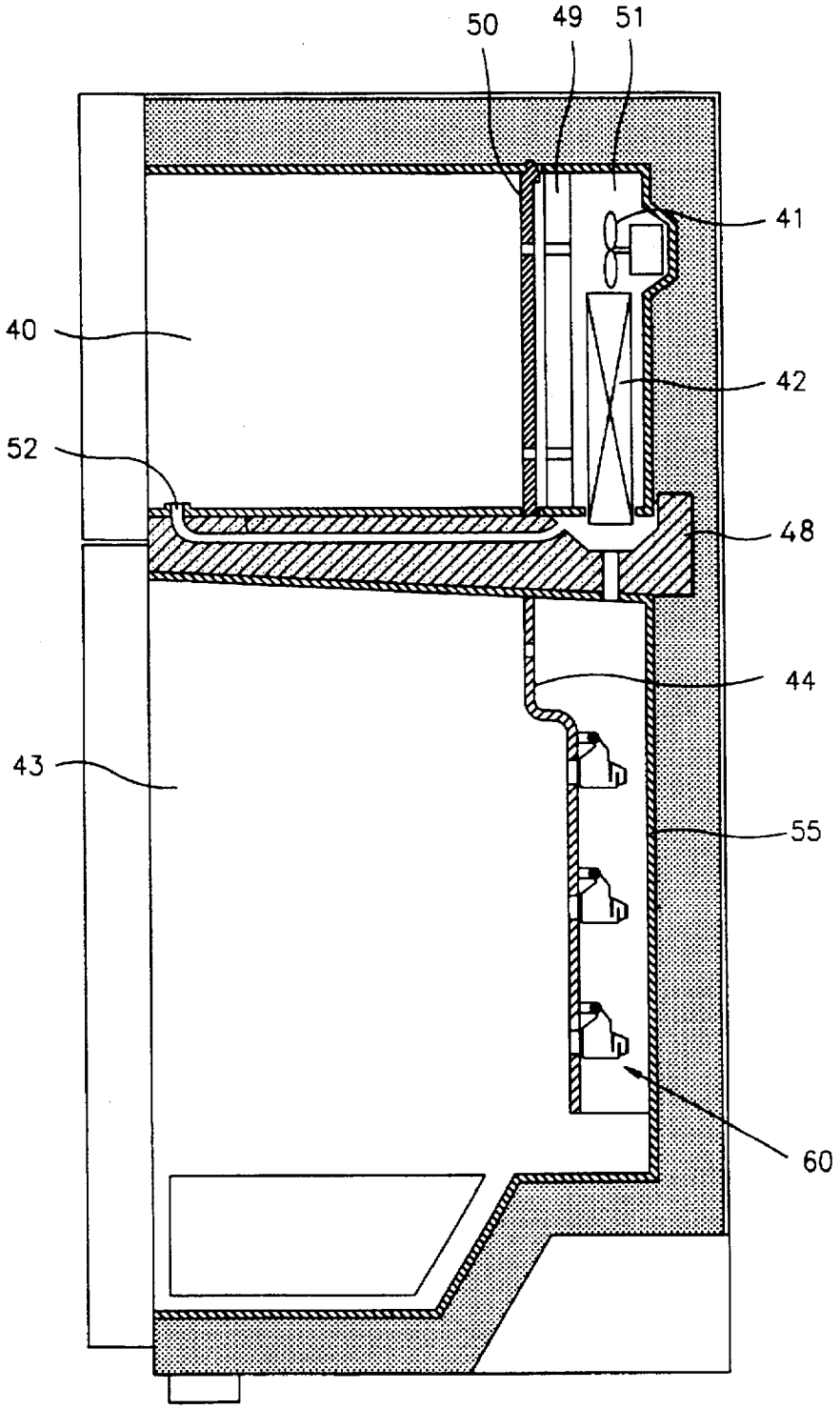
FIG. 14 is a cross-sectional view illustrating the construction of a refrigerator in which a cooling air distribution apparatus according to a second embodiment of the present invention is installed.
Figure 15A:
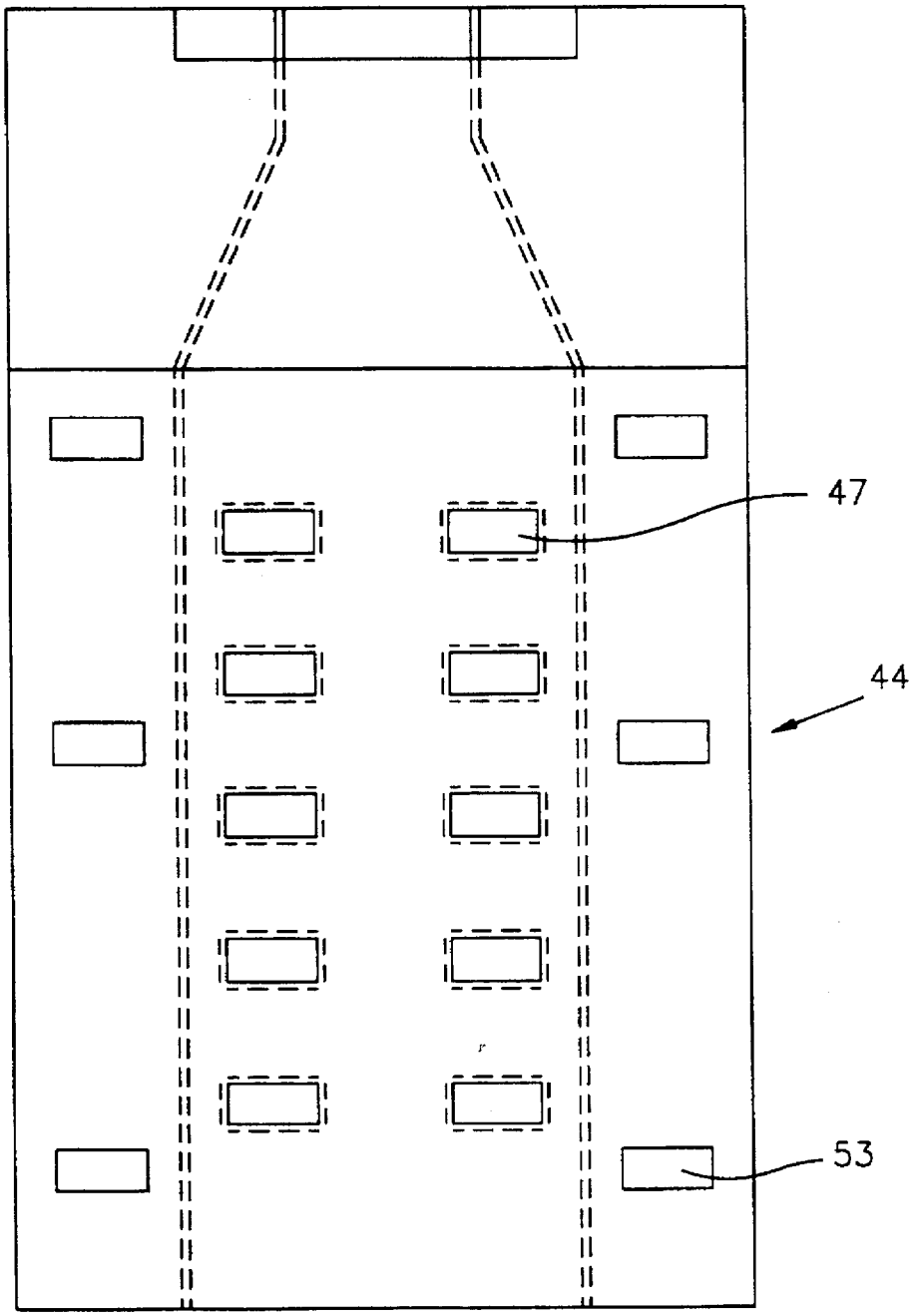
FIG. 15A is a front view illustrating a cooling air distribution duct of the cooling air distribution apparatus for a refrigerator as shown in FIG. 14.
Figure 15B:
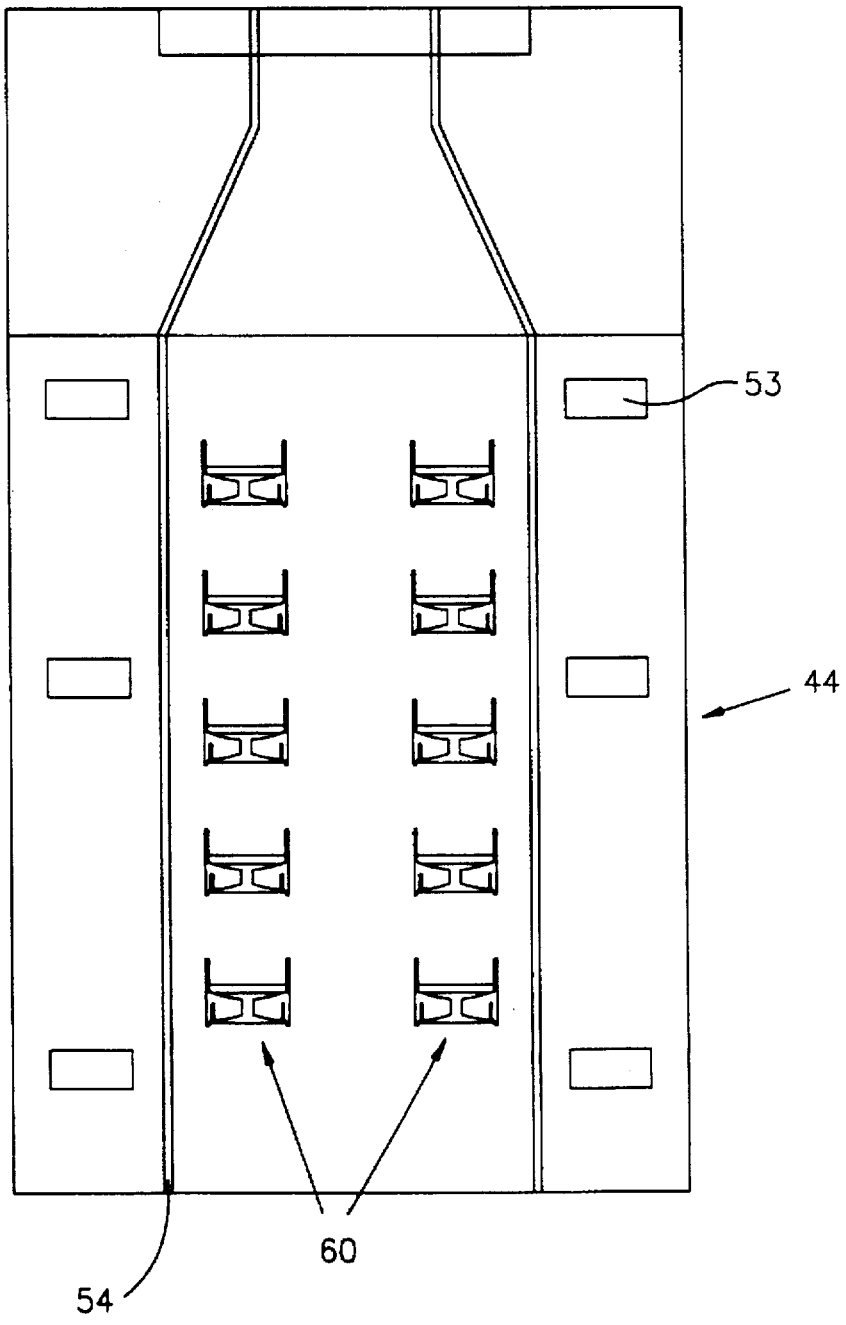
FIG. 15B is a rear view illustrating the cooling air distribution duct of the cooling air distribution apparatus for a refrigerator as shown in FIG. 14.

In a bottom surface 93 and an inner wall surface 94 of the guide channel 92, a plurality of cooling air discharge holes 95 are formed. A plurality of hooks 96, as shown in FIG. 11, to be engaged to the fixing groove 86 of the lower surface 86 are formed on the upper edges of the guide channel 92 in order for the guide channel 92 to be tightly attached to the lower surface 82 of the upper plate 80.

The cooling air conduit 97 is engaged to the inlets 91 of the cooling air guide members 90. The cooling air conduit 97 can be inserted into the cooling air inlet 47 for opening the opening/closing plate 63 of the opening/closing member 60 and includes a cut-away end portion 98 in order for the cooling air flowing along the cooling air distribution duct 44 to be guided thereinto.

The operation and effects of the cooling air distribution apparatus according to the first embodiment of the present invention will now be explained.

First, the fixing hooks 96 of the cooling air guide members 90 are inserted into the fixing grooves 86 in the upper plate 80, for thus coupling the upper plate 80 and the cooling air guide members 90. The inlets 91 of the cooling air guide members 90 are inserted into the cooling air conduit 97 through the notches 85 in the upper plate 80, for thus assembling the rack duct 74.

Thereafter, when sliding the rack duct 74 into a receiving groove 46, the cut-away portion of the cooling air introduction guide portion 97 pushes open the opening/closing plate 63 against the force of the elastic member 64, for thus opening the cooling air inlet 47.

The cooling air introduced through the cooling air inlet 47 is moved along the channel 92 coupled with the upper plate 80 and is then discharged into the refrigerator compartment 43 through the cooling air discharge holes 95 formed in the inner wall surface 94 and the bottom surface 93 thereof.

The cooling air is downwardly discharged into the refrigerator compartment 43, for thus causing a spiral flow therein, so that foods placed on the rack can be evenly cooled.

When a bulky food is placed on the rack, or when it is desired to change the position of the rack duct 74, it is possible to detach the rack duct 74 by forwardly pulling the front of the rack duct 74 to be detachably disengaged from the receiving groove 46. When the rack duct 74 is detached therefrom, the opening/closing plate 63 of the opening/closing member 60 automatically closes the cooling air inlet 47 due to the elastic force of the elastic member 64.

The thusly detached rack duct 74 may be inserted into another receiving groove 46 for obtaining a desired space for the bulky food.

In addition, since the support bar 83 is formed along the bottom surface 82 of the upper plate 80, the rack duct 74 is capable of fully supporting heavy foods.

As described above, the cooling air distribution apparatus for a refrigerator according to the first embodiment of the present invention is basically directed to evenly distributing cooling air into the refrigerator compartment and minimizing a loss of the cooling air even when opening a refrigerator compartment door.

In addition, since the support bar is formed in the rack duct, it is possible to prevent a flexing of the rack duct.

Moreover, it is possible to enhance the space usage efficiency in the refrigerator compartment.

FIGS. 14 through 17 are views illustrating a cooling air distribution apparatus for a refrigerator according to another embodiment of the present invention;

As shown therein, the freezer compartment 40 and the refrigerator compartment 43 are separated by a barrier 48. A shroud 49 and a grill panel 50 are disposed in a rear portion of the freezer compartment 40.

An evaporator chamber 51 is formed behind the shroud 49. The fan 41 and the evaporator 42 are disposed in the evaporator chamber 51.

A returning path 52 is formed within the barrier 48 through which the air circulated in the freezer compartment 40 to the evaporator chamber 51.

The cooling air distribution duct 44 is disposed in a rear portion of the refrigerator compartment 43 for guiding the cooling air introduced thereinto from a refrigerator compartment damper (not shown) into the refrigerator compartment 43.

A plurality of openable/closeable cooling air inlets 47 are formed along the central portion of the cooling air distribution duct 44, through which inlets 47 cooling air may be discharged into the refrigerator compartment 43. In addition, a plurality of cooling air outlets 53 are formed in the outer portion of the cooling air distribution duct 44, through which the air circulated in the refrigerator compartment 43 is returned to the evaporator chamber 51.

A separation wall 54 is arranged between the cooling air inlets 47 and the cooling air outlets 53 in order for the cooling air introduced from the cooling air inlets 47 and the cooling air discharged through the cooling air outlets 53 to be separated from each other.

An inner casing 55 is disposed in a rear portion of the refrigerator compartment 43.

An opening/closing member 60' is hinged to the inner side of the cooling air distribution duct 44 at each inlet 47 by a hinge pin 62 supported by hinge supports 61' for selectively opening/closing the cooling air inlets 47.

Figure 16A:
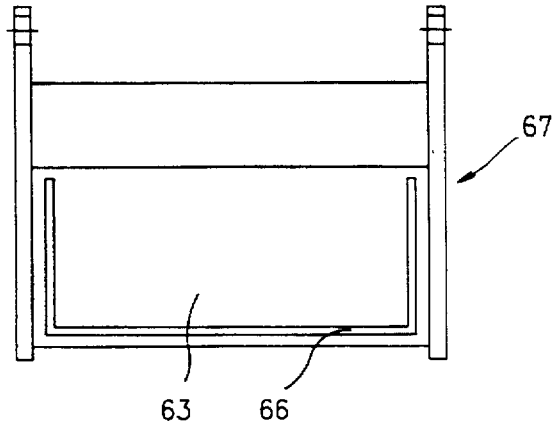
FIG. 16A is a front view illustrating a gravity type opening/closing member of a cooling air distribution apparatus for a refrigerator as shown in FIG. 14.
Figure 16B:
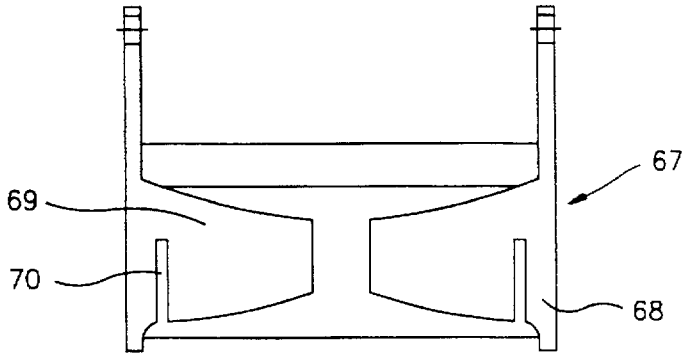
FIG. 16B is a rear view of the opening/closing member in FIG. 16A.
Figure 16C:
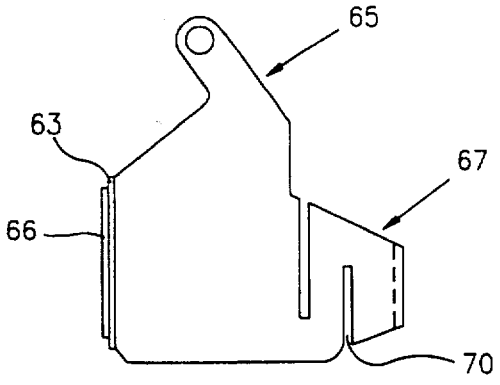
FIG. 16C is a side view of the opening/closing member in FIG. 16A.

Referring to FIGS. 16A through 16C, the opening/closing member 60' will be explained in more detail.

An opening/closing plate 63 having a sealing rib 66 provided along the front thereof is formed at the front of a main body 65 for opening/closing the cooling air inlets 47.

An elastic member 67 is disposed at a rear portion of the main body 65 for elastically supporting the opening/closing member 60' when the elastic member 67 comes into contact with the inner casing 55.

The elastic member 67 further includes a vertically formed first elastic support portion 68, a second elastic support portion 69 vertical with respect to the first elastic support portion 68, and a plurality of slits 70 for forming a shaped elastic space therebetween.

When a rack duct 74 is inserted into the cooling air inlet 47 for guiding the cooling air flowing in the cooling air distribution duct 44, the cooling air inlet 47 is opened by the opening/closing plate 63.

Identically to the first embodiment, the rack duct 74 includes a cut-away end portion 98 which is cut-away at a predetermined angle for a tighter engagement between the rack duct 74 and the opening/closing plate 63. Namely, the rack duct 74 has the same construction as in the first embodiment of the present invention.

The operation and effects of the cooling air distribution apparatus for a refrigerator according to another embodiment of the present invention with reference to FIGS. 14 through 17B.

First, the cut-away portion 98 of the rack duct 74 is inserted into the cooling air inlet 47, and the cut-away portion 98 of the rack duct 74 inwardly pushes the opening/closing plate 63 of the opening/closing member 60' hinged to the inner surface of the cooling air distribution duct 44.

The main body 65 of the opening/closing member 60' rotates in the counterclockwise direction about the hinge pin 62 of the hinge supports 61, and the cut-away portion 98 of the rack duct 74 comes into tight contact with the opening/closing plate 63, and the elastic member 67 comes into contact with the inner casing 55.

Figure 17A:
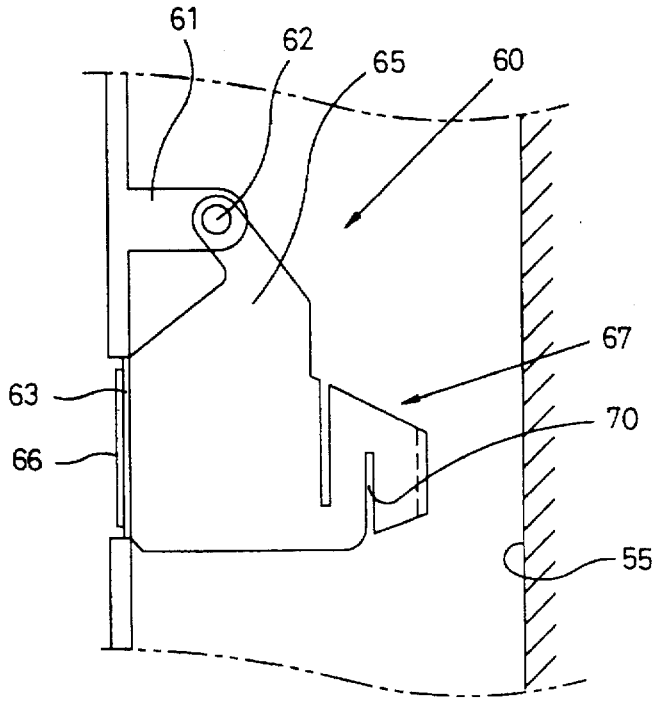
FIG. 17A is a partial side view illustrating a state that a rack duct of a cooling air distribution apparatus for a refrigerator according to the present invention is not inserted into a cooling air inlet.
Figure 17B:
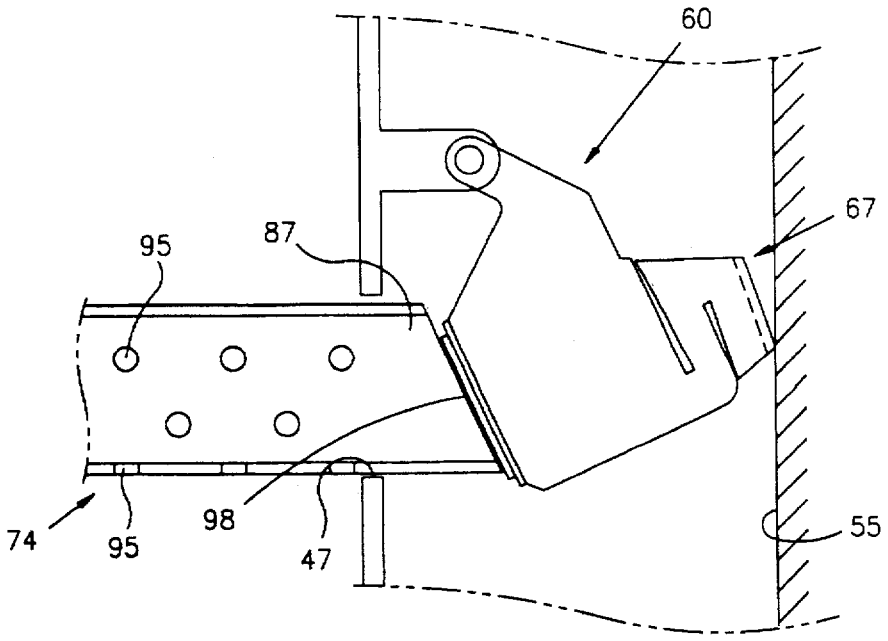
FIG. 17B is a partial side view illustrating a state that a rack duct of a cooling air distribution apparatus for a refrigerator according to the present invention is inserted into a cooling air inlet.

Namely, when the rack duct 74 is engaged in the refrigerator compartment 43, as shown in FIG. 17B, the elastic member 67 of the opening/closing member 60' comes into contact with the inner casing 55. At this time, the first elastic support portion 68 is elastically compressed by an elastic force generated by the plurality of the elastic slits 70.

At the same time, the second elastic support portion 69 is also elastically compressed by an elastic force generated by the plurality of the elastic slits 70.

Next, when it is needed to separate the rack duct 74 from the cooling air inlet 47 for changing a refrigerating space in the refrigerator compartment 43, the front portion of the rack duct 74 is frontwardly pulled out. The opening/closing plate 63 of the opening/closing member 60 rotates in the clockwise direction with respect to the hinge pin 62 in cooperation with the elastic force generated by the first and second elastic support portions 68 and 69, for thusly closing the cooling air inlet 47 of the cooling air distribution duct 44.

The cooling air sealing rib 66 comes into tight contact with the inner surface of the cooling air inlet 47 for preventing the cooling air from flowing into the refrigerator compartment 43, and the first and second elastic support portions 68 and 69 return to their original shape.

In a state that the rack duct 74 is inserted into the cooling air inlet 47, when the refrigerator is operated, the cooling air generated by the evaporator 42 is discharged through the shroud 49, and the grill panel 50 in cooperation with the blowing force generated by the fan 41. The thusly discharged air is circulated in the freezer compartment 40 and then is returned to the evaporator chamber 51 through the returning path 52. Another part of the cooling air generated by the evaporator 42 is downwardly blown into the cooling air distribution duct 44 through the barrier 48.

The downwardly flowing cooling air is introduced into the rack duct 74. The cooling air in the rack duct 74 is discharged into the refrigerator compartment 43 through the plurality of the cooling air discharge holes 95.

The air circulated in the refrigerator compartment 43 is returned to the evaporator chamber 51 through the cooling air outlets 53.

Since the cooling air separation wall 54 is disposed in the cooling air distribution duct 44, the returning air and the discharging cooling air are not mixed together. Therefore, it is possible to independently separate the returning air and the discharging cooling air.

As described above, the cooling air distribution apparatus for a refrigerator according to the present invention is directed to discharging the cooling air in the multiple directions by guiding the cooling air flowing along the cooling air distribution duct to the rack duct, for thus more efficiently circulating the cooling air.

In addition, it is possible to easily move the rack duct based on the size and shape of the food to be placed in the refrigerator compartment, for thus increasing the usage space of the refrigerator compartment.

Moreover, it is possible to increase the refrigerating efficiency by blocking the cooling air from flowing out of the cooling air inlet by using the opening/closing member when changing the position of the rack duct.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A cooling air distribution apparatus for a refrigerator having a refrigerating compartment including a cooling air distribution duct means for distributing cooling air to the refrigerating compartment, comprising:

a plurality of receiving groove means formed in a front surface of the cooling air distribution duct and each side wall surface in the refrigerator compartment;

a plurality of cooling air inlet means formed in the receiving groove for introducing the cooling air into the refrigerator compartment;

an opening/closing means hinged to a reverse side of each cooling air inlet means for opening/closing the cooling air inlet means;

a rack duct means including an upper plate having:

an upper portion having a predetermined thickness and size;

a first lower surface having a predetermined thickness;

a support portion formed in the first lower surface for supporting the upper portion;

a downwardly extended elongated edge portion;

a pair of engaging slits formed in the edge portion and spaced-apart with respect to the support portion; and a plurality of fixing grooves formed in the first lower surface;

a cooling air guide member having:

an inlet portion protruding from one side of the cooling air guide member for introducing the cooling air into the rack duct therethrough;

a curved guide portion for guiding the cooling air introduced thereinto through the inlet portion to the support portion and the edge portion;

a plurality of cooling air holes formed in the inner surface of the guide portion and a second lower surface for introducing the cooling air into the refrigerator compartment therethrough;

a plurality of fixing hooks mating with the plurality of the fixing grooves to enable the guide portion to tightly engage the lower surface of the upper plate; and a cooling air introducing guide engaged with the inlet portion of the cooling air guide member for opening the opening/closing means and for guiding the cooling air from the cooling air distribution duct toward the inlet portion of the cooling air guide member, wherein the rack duct means is insertable into each receiving groove and each cooling air inlet means for discharging the cooling air into the refrigerator compartment in multiple directions.

2. The cooling air distribution apparatus of claim 1, wherein said opening/closing means comprises:

a pair of hinge support means formed at each side of the the cooling air inlet on an inner side of the cooling air distribution duct;

a hinge pin means rotatably inserted into the hinge support means;

an opening/closing plate means engaged to the hinge pin for opening/closing the cooling air inlet; and an elastic member means for urging the opening/closing plate means into a closed position.

3. The cooling air distribution apparatus of claim 1, wherein said cooling air introducing guide includes a cut-away portion which is cut at a predetermined angle for more effectively guiding the cooling air.

4. A cooling air distribution apparatus for a refrigerator, comprising:

a cooling air distribution duct means having:

a plurality of cooling air inlets formed therein for introducing cooling air generated by an evaporator into a refrigerator compartment and spaced-apart from one another; and a plurality of air outlets formed therein for sucking air circulated in the refrigerator compartment and spaced-apart from one another;

an opening/closing means disposed at a reverse side of each cooling air inlet for opening/closing the cooling air inlets, including a pair of spaced-apart hinge supports protruding from both sides of the reverse side of each cooling air inlet;

a hinge pin rotatably inserted to both ends of the hinge support;

a main body of which its upper portion is engaged to the hinge pin;

an opening/closing plate formed in one side of the main body for opening/closing the cooling air inlet;

a cooling air sealing rib attached to the upper surface of the opening/closing plate for preventing leakage of the cooling air between the cooling air inlet and the main body of the opening/closing means; and an elastic member formed in another side of the main body for generating an elastic force for urging the cooling air leakage prevention rib of the main body to tightly contact with the reverse side of the cooling air inlet; and a rack duct of which its front end is inserted into the cooling air inlet of the cooling air distribution duct means for discharging the cooling air form the cooling air distribution duct means into the refrigerator compartment in multiple directions.

5. The cooling air distribution apparatus of claim 4, wherein said cooling air distribution duct means includes a separation wall between the cooling air inlets and the air outlets for separating between the cooled air introducing through the cooling air inlets and the air circulated in the refrigerator compartment.

6. A cooling air distribution apparatus for a refrigerator, comprising:

a cooling air distribution duct means having:

a plurality of cooling air inlets formed therein for introducing cooling air generated by an evaporator into a refrigerator compartment and spaced-apart from one another; and a plurality of air outlets formed therein for sucking air circulated in the refrigerator compartment and spaced-apart from one another;

an opening/closing means including an opening/closing plate disposed at a reverse side of each cooling air inlet for opening/closing the cooling air inlets;

a rack duct of which its front end is inserted into the cooling air inlet of the cooling air distribution duct means for discharging the cooling air form the cooling air distribution duct means into the refrigerator compartment in multiple directions; and wherein a front end of said rack duct includes a cut-away portion which is cut at a predetermined angle for a tight contact with the opening/closing plate of the opening/closing means when the front end thereof is inserted into the cooling air inlet.

7. The cooling air distribution apparatus of claim 4, wherein said elastic member of the opening/closing means includes:

a first elastic support portion vertically formed at both sides of the main body;

a second elastic support portion formed vertical with respect to the first elastic support portion; and slits formed between the first and second support portions in order for the first and second elastic support portions to elastically deform under a predetermined elastic force.

* * * * *